United States Patent [19]

Korzaniewski

[11] 4,441,706

[45] Apr. 10, 1984

[54] WEIGHT LIFTING TYPE EXERCISING DEVICE

[76] Inventor: Mark M. Korzaniewski, 187 Nancy Crest La., West Seneca, N.Y. 14224

[21] Appl. No.: 431,793

[22] Filed: Sep. 30, 1982

[51] Int. Cl.[3] ..... A63B 21/06

[52] U.S. Cl. ..... 272/118; 272/76; 272/144; 272/123; 272/134

[58] Field of Search ..... 272/118, 93, 123, 122, 272/77, 78, 134, 144

[56] References Cited

U.S. PATENT DOCUMENTS 1,928,089 9/1933 Blickman ..... 272/118 X
4,361,323 11/1982 Segersten ..... 272/118

OTHER PUBLICATIONS

"All-in-One"-Marcy Gym Equip. Catalogue Oct. 7, 1969, p. 28.

*Primary Examiner*—Richard J. Apley
*Assistant Examiner*—William R. Browne
*Attorney, Agent, or Firm*—Harvey B. Jacobson

[57] ABSTRACT

An exercising machine including a vertically disposed framework defined by a pair of parallel, vertical, channel-shaped side members interconnected at their top by a top connecting member and having stabilizing supporting feet extending horizontally at their lower ends. The side members support independent slides in the form of inner channels having an inwardly extending arm and an upwardly extending peg thereon for receiving a desired number of barbell weights with a cable and pulley system being associated with the slides to enable independent vertical movement of the slides by pulling downwardly on independent handles or pulling upwardly on independent handles depending upon the manner in which the cable and pulley systems are associated. A locking bar is provided to selectively interconnect the arms on the two slides together with a central pulley system and cable system enabling the two slides and the weights thereon to be lifted by a single cable. The side members include apertures receiving pins to support a barbell assembly or to support the slides in a predetermined elevated rest position and to support one end of a sit-up board. An extension is provided at the top of the framework having a central pulley thereon receiving the cable attached to the locking bar and also providing a support for a heavy punching bag with both the extension and the locking bar including a feature to enable attachment of a handlebar to facilitate various optional uses of the exercising machine. The stabilizing feet at the lower end of the framework are interconnected by a connecting bar having pulleys mounted thereon and also a mounting structure for a T-bar on which weights may be placed to facilitate additional optional uses of the exercising machine.

10 Claims, 6 Drawing Figures

FIG. 1
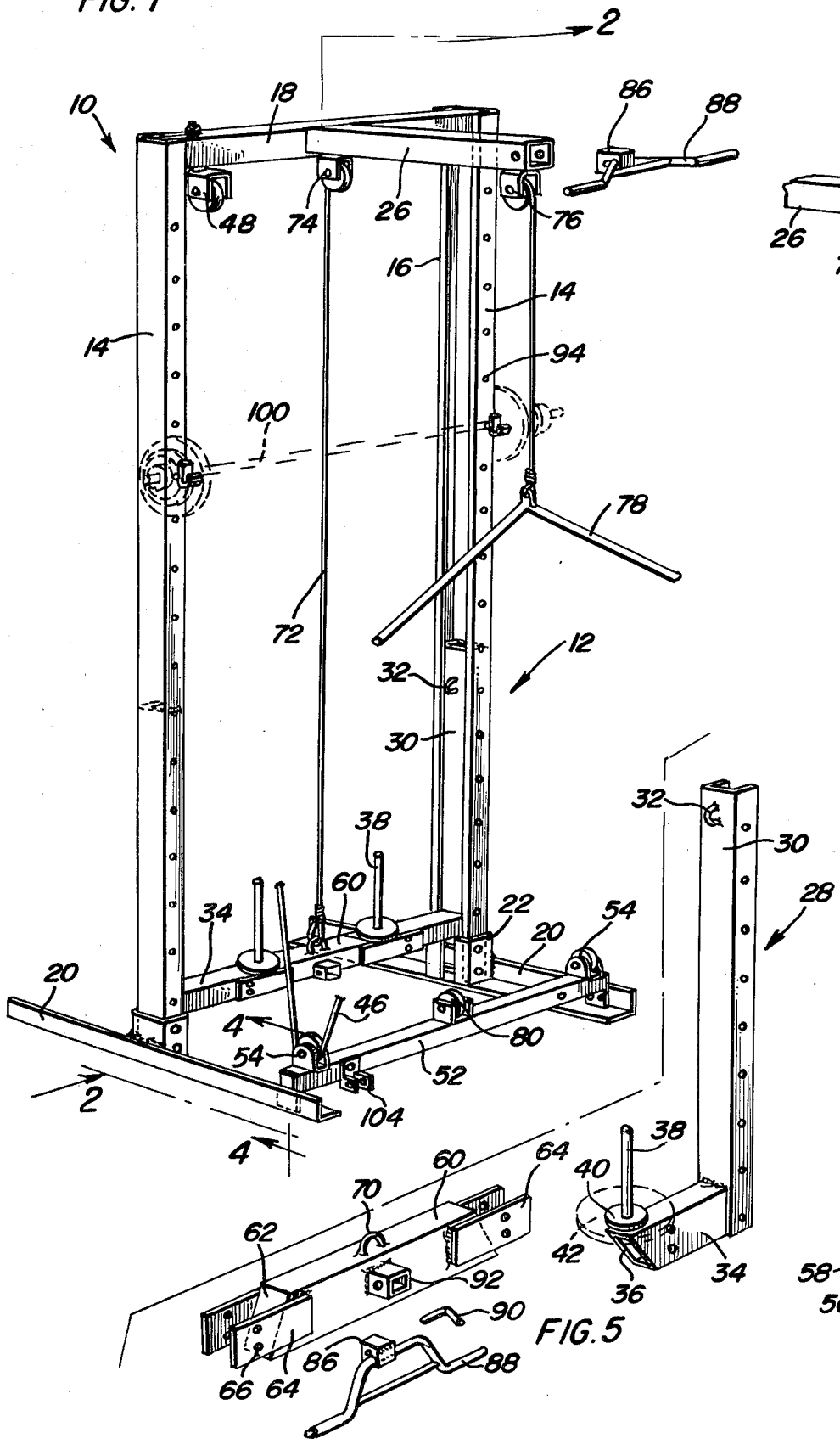
FIG. 5
FIG. 6
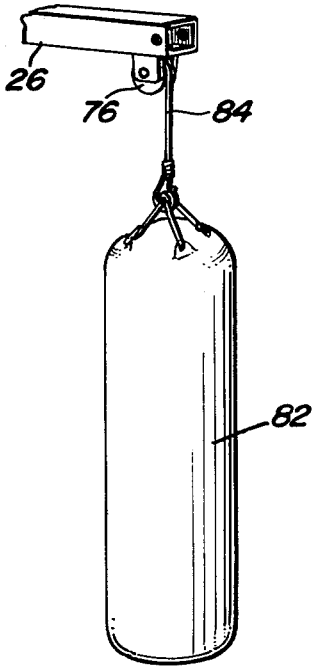
FIG. 4
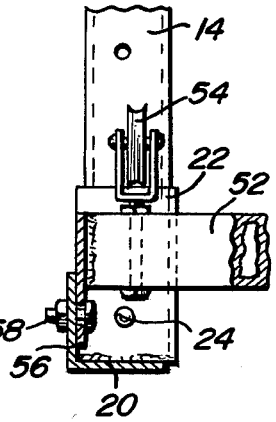

WEIGHT LIFTING TYPE EXERCISING DEVICE

BACKGROUND OF THE INVENTION

1. Field of the Invention

The present invention generally relates to exercising machines and more particularly an exercising machine which is relatively simple in construction but capable of orientation of its components into various arrangements enabling various optional modes of use of the machine thereby facilitating the performance of various exercises with a single machine or apparatus.

2. Description of the Prior Art

Exercising apparatuses and machines have been developed to provide various types of exercises with specialized apparatuses being provided to enable practice of different types of exercises. Also, some machines have been developed to enable optional modes of use to provide for various exercises to be practiced on a single apparatus. The following prior U.S. patents are exemplary of the art in this field of endeavor:

U.S. Pat. No. 3,115,339; 12/24/63
U.S. Pat. No. 3,346,256; 10/10/67
U.S. Pat. No. 4,109,907; 08/29/78
U.S. Pat. No. 4,257,590; 03/24/81
U.S. Pat. No. 4,316,609; 02/23/82

SUMMARY OF THE INVENTION

An object of the present invention is to provide an exercising machine having a vertical framework defined by vertical side members and an interconnecting top member with the side members having independent slides mounted thereon with each slide being capable of supporting selected weights and connected with a cable and pulley assembly to enable independent vertical movement of the slides by using independent cables having independent handles on the free ends thereof with the pulley and cable assemblies enabling the handles to be moved either downwardly to lift the slides and weights thereon or upwardly to lift the slides and weights thereon.

Another object of the invention is to provide an exercising machine in which the slides can be interconnected with a locking bar to provide a single transverse member between the side members with a central pulley and cable system being connected to the locking bar and positioned over a central pulley system with a portion of the central pulley system being supported by an extension on the top member of the vertical framework thereby enabling an optional mode of use of the exercising machine.

A further object of the invention is to provide an exercising machine in which the vertical framework includes horizontally disposed supporting feet at the lower end thereof with the supporting feet being connected by a connecting bar adjacent one end portion thereof spaced from the framework with a portion of the pulley assembly being mounted thereon with the connecting bar being detachably supported from the bottom members or feet to enable placement of or removal of the connecting bar.

Still another object of the invention is to provide an exercising machine in accordance with the preceding objects in which the vertical side members are provided with apertures receiving pins with supporting hook brackets thereon in order to provide support for conventional barbell assemblies and also to support the slide assemblies when interconnected by the connecting bar at a predetermined point so that the connected slides can be moved upwardly but will not move below a predetermined elevation to enable leg exercises to be practiced on the machine.

A still further object of the invention is to provide an exercising machine in accordance with the preceding objects in which the connecting bar between the slides and the free outer end of a horizontal extension on the top of the framework have features receiving a handlebar to enable additional exercises to be practiced.

Yet another object of the invention is to provide an exercising machine in which the components may be arranged to support an inclined sit-up board and a weighted T-bar to enable additional modes of use of the exercising machine.

An additional object of the present invention is to provide an exercising machine which is dependable, safe and long lasting with the components being easily and quickly oriented in various arrangements to facilitate various modes of use.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the exercising machine of the present invention with various optional modes of use being illustrated.

FIG. 4 is a fragmental sectional view taken substantially upon a plane passing along section line 4—4 of FIG. 1 illustrating further structural details of the supporting feet and connecting bar therebetween.

FIG. 5 is an exploded group perspective view of one of the slides and the connecting bar associated therewith together with the association of the handlebar therewith.

FIG. 6 is a fragmental perspective view of the top extension illustrating a weight bag supported therefrom.

DESCRIPTION OF THE PREFERRED EMBODIMENT

Figures 2, 3:
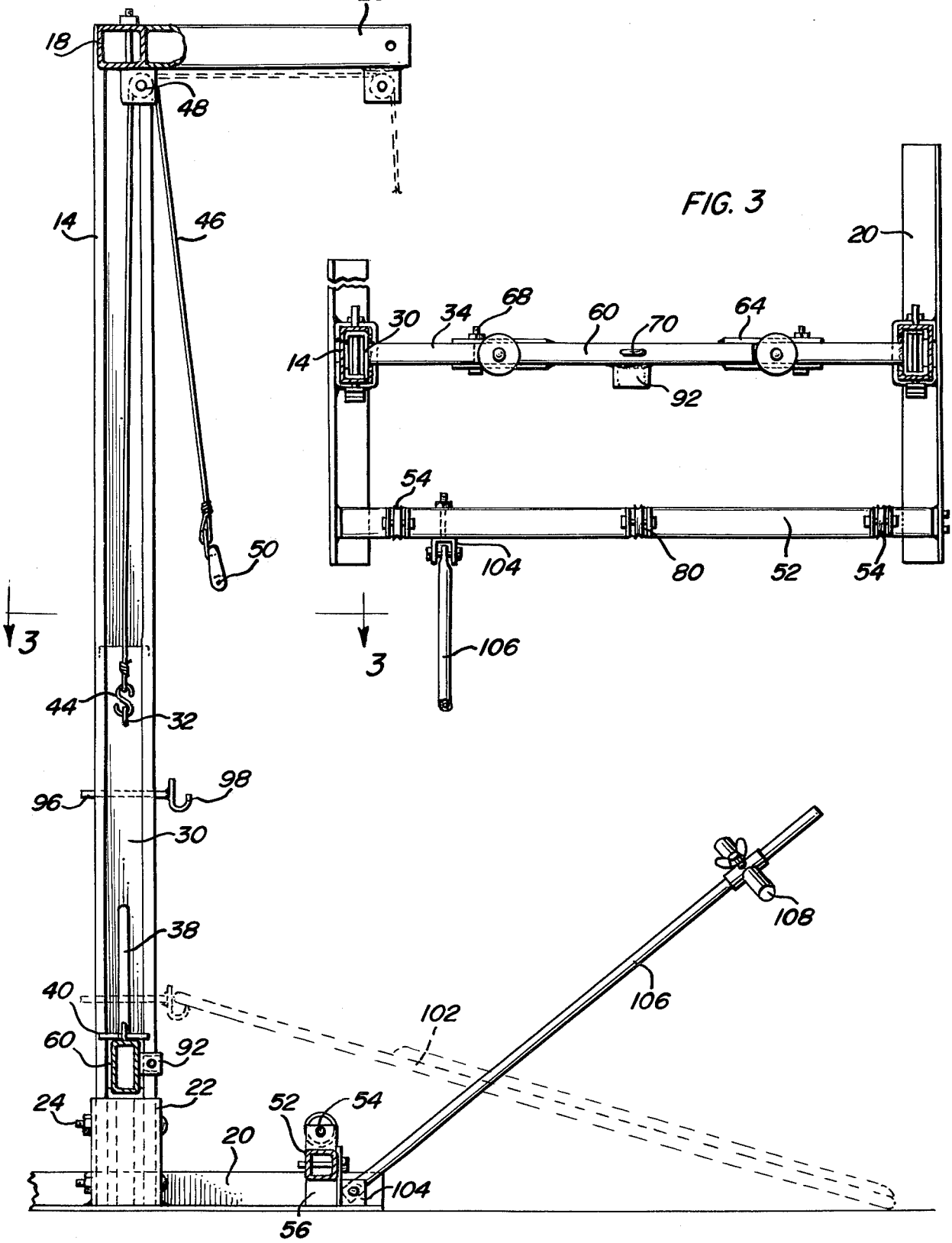
FIG. 2 is a vertical sectional view of the machine taken generally upon a plane passing along section line 2—2 of FIG. 1 but illustrating independent elevation of the slides.
FIG. 3 is a plan sectional view taken substantially upon a plane passing along section line 3—3 of FIG. 2.

The exercising machine of the present invention is generally designated by the reference numeral 10 and includes a framework 12 which is vertically oriented and includes a pair of parallel, vertically disposed, channel-shaped side members 14 which face inwardly and include inwardly extending edges or lips 16 to provide an inwardly opening channel-shaped member with the free edges of the lips 16 defining a vertical guide or trackway. The upper ends of the side members 14 are rigidly interconnected by a top connecting member 18 of square tubing or the like with the top member 18 rigidly affixed to the side members 14 as by welding or the like although rigid bolting arrangements may be employed. At the bottom of each side member 14, a bottom member or elongated foot 20 of angle iron configuration is attached with the foot 20 including a short sleeve 22 of channel shaped configuration telescopingly receiving the lower end of the corresponding side member 14 and being secured thereto by bolts or rivets 24 with bolts enabling disassembly of these components. The bottom feet 20 stabilize and support the framework 12 in a vertical upright position. Also, the center of the top connecting member 18 is provided with an extension member 26 rigidly affixed thereto in perpendicular relation and in the same horizontal plane as the top member 18 as illustrated in FIG. 1 with the extension member also being of tubular configuration and welded or otherwise rigidly affixed to the top member 18. This structure represents the basic framework structure and these components are constructed of materials having a size providing necessary strength capabilities for use as an exercising device. If desired, the bottom members or feet 20 may be anchored to a supporting surface or left free of the supporting surface to enable the exercising machine 10 to be oriented in various desired positions. Also, the framework components may be rigidly affixed together by removable bolts or permanently and rigidly fixed together as by welding, rivets and the like. Usually, it is desirable for the side members 14 and the top member 18 as well as the extension 26 to be welded together with the feet 20 detachable although all components may be welded or detachable as desired.

Each of the side members 14 includes a slide generally designated by numeral 28 which includes a slide member 30 in the form of a channel shaped member which may be considered an inner channel since it is slidably received in the channel-shaped side member 14 as illustrated in FIG. 3. The slide member 30 is slidingly and closely received within the channel-shaped side member 14 and is vertically elongated as illustrated in FIGS. 1, 2 and 5 with the web portion of the channel-shaped slide member 30 facing the vertical track between the edges of the inturned lips or edges 16 on the side members 14 with the upper end of the slide member 30 having a loop 32 rigid with the inwardly facing surface thereof which extends inwardly beyond the side member 14. The lower end of the slide member 30 includes an inwardly extending arm 34 of square tubing configuration having an upwardly and inwardly inclined inner edge 36 and an upwardly extending peg 38 on the inner upper surface thereof as illustrated in FIG. 5. The lower end of the peg 38 includes a plate 40 engaging the upper surface of the arm 34 with these components being rigidly secured to the arm 34 with the upper end of the peg 38 being rounded to facilitate placement of and removal of one or more barbell weights 42.

To provide vertical movement to the slide 28, an S-hook 44 is attached to loop 32 with a vertically disposed cable 46 connected to the S-hook 44 with the cable being entrained over a swivel pulley 48 attached to the underside of the top member 18 adjacent the side member 14. The cable 46 then extends downwardly and terminates with a loop handle 50 on the free end thereof. Each of the slides 28 is provided with an independent cable so that a person using the exercising machine may grasp the two handles 50 in their hands and perform various exercises by moving the slides 28 and any weights 42 thereon vertically in various arrangements by pulling down on the handles in alternating fashion or in unison as desired.

In order to be able to perform exercises by pulling upwardly on the handles 50, a connecting bar 52 is provided between the outer ends of the bottom members or feet 20 as illustrated in FIG. 1 with a swivel pulley assembly 54 mounted on the upper surface of the connecting bar 52 adjacent each end thereof so that the cable 46, of a longer length, may be extended under the corresponding pulley 54 and then extend upwardly with the loop handle 50 attached thereto so that various exercises may be performed by pulling upwardly on the loop handles 50 either alternately or in unison. The arrangement of the cable 46 extending under one of the side pulleys 54 on the connecting bar 52 is illustrated in FIG. 1 at the lower left portion thereof. The connecting bar is detachably connected to the angle iron bottom members 20 by use of an end tab 56 which depends therefrom along the inner surface of the upwardly extending flange of the angle iron bottom member 20 with bolts 58 detachably securing the connecting bar 52 in place with the connecting bar 52 also being preferably of square tube configuration. The specific construction of the pulleys is conventional and includes the usual grooved pulley wheel supported in a U-shaped yoke having a stem extending through and swivelly retained to its mounting structure.

In order to provide additional optional modes of use of the exercising machine, a locking bar 60 is provided to interconnect the arms 34 of the slides 28 thereby forming, in effect, a continuous horizontal arm rigidly interconnecting the slides 28. The locking bar 60 is of square tubular construction with the ends thereof being closed if desired or left open but being inclined as at 62 to abuttingly engage the inclined ends 36 of the arms 34. Each end of the locking bar includes a pair of parallel connecting tabs 64 welded to the locking bar and extending along the opposed surfaces of the arm 38 with the tabs 64 and the arms 34 each including apertures 66 to receive connecting bolts 68 as illustrated in FIG. 3 thereby providing a continuous horizontal member rigidly interconnecting the slides 28 so that the slides 28 and all of the weights 42 thereon may be moved simultaneously and constitute a single movable component.

The center top of the locking bar 60 is provided with a loop 70 to which a cable 72 is attached with the cable 72 extending over a center pulley 74 which may be a swivel pulley mounted at the underside of the center of the top member 18 with the cable then extending downwardly to a handle structure or extending under the extension member 26 and over an extension pulley 76 in alignment with pulley 74 and also being a swivel pulley. The cable 72 then extends downwardly and terminates in a connection with an elongated shallow V-shaped handlebar 78 with the cable being attached to the center thereof as illustrated in FIG. 1. Thus, various exercises may be performed by the person using the machine grasping the handle bar 78 and pulling its downwardly to elevate the connected slides 28 and the weights 42 thereon. Also, the assembly may be used in an optional mode in which the cable 74 extends downwardly and is entrained under a center swivel pulley 80 mounted on the connecting bar 52 between the bottom members 20. The connecting bar 52 is in parallel relation to the top member 18 but spaced from the side members 14. Thus, with this arrangement, various exercises may be performed by moving the handlebar 78 upwardly.

FIG. 6 illustrates an alternative mode of use of the exercising machine in which a heavy weight bag or punching bag 82 is supported by a cable 84 from the extension pulley 76 with the cable 84 being either attached to the locking bar 60 or a short cable may be merely terminally connected to the pulley 76 or to the extension member 26. Also, the extension member 26 has an open outer end to receive a mounting bracket or block 86 on a handle bar assembly 88 so that the block 86 can telescope into the open end of the tubular extension member 26 and be secured thereto by an insertable pin 90 of right angular configuration which extends through aligned apertures in the extension member 26 and the block 86. The handlebar 88 then may be used for various exercises in which the handlebar 88 is rigidly supported in a horizontal position at an elevated orientation for performing various exercises.

Also, the locking bar 60 is provided with a tubular sleeve 92 rigid therewith and provided with aligned apertures for receiving the mounting block 86 of the handlebar 88 thereby providing alternative mounting of the handlebar on the locking bar 60 so that the interconnecting slides 28 can be lifted by using the handlebars 88 to perform additional exercises.

The side members 14 have a plurality of vertically spaced apertures 94 which extend through the flanges of the channel shaped side members 14 to receive an elongated pin 96 having a hook shaped supporting bracket 98 on one end thereof so that when the pins 96 are inserted in place, a barbell assembly 100 may be supported from the hooks 98 to facilitate use of the barbells and provide support of the barbells at a desired elevated position when desired in performing various exercises. The pin 96 can be inserted in any of the pairs of holes 94 which enable the pins to be inserted under the connected slides 28 so that the slides 28 may be supported in an elevated position enabling a person to position themselves under the slides 28 and move the slides 28 upwardly when connected by the locking bar either by using their hands or feet thereby enabling additional exercises to be performed. Also, the pins 96 and the hooks 98 are used to support one end of an inclined sit-up board 102 as illustrated in FIG. 2 so that the person may use the sit-up board for performing various exercises. Also, the connecting bar 52 has a bracket 104 attached to either end thereof by providing duplicate mounting holes for a supporting bolt with the bracket 104 having a bar 106 pivotally connected thereto and the bar 106 has a longitudinally adjustable cross handle 108 attached thereto thus forming a T-bar with the bar 106 having weights 42 positioned thereon to enable various exercises to be performed while using the sit-up board or in the other modes.

The dimensional characteristics of the exercising machine may vary but in one typical installation, the height of the framework may be on the order of 7 feet while the width of the framework may be 3½ to 4 feet and the length of the extension may be about 2 feet and the various components may be standard structural shapes and configurations rendering the device relatively inexpensive to manufacture and also safe in operation and long lasting. Various types of exercises may be performed with the change in direction of movement of the free ends of the cable being a significant factor to enable a wide diversity of exercises to be performed. Supporting the barbells at a desired elevation enables exercises such as squats or the like to be performed and elevated sit-ups may be provided on the inclined board. With the handle bar assembly connected to the locking bar 60, a person may rest on the floor and use the handlebar to elevate the interconnected slide members with the pins determining the point at which the weights on the slide and the slides 28 come to rest. With the handlebar removed, the user can lay beneath the locking bar and raise the weights with his/her legs and again by using the pins to adjust the resting point, various leg exercises can be performed with variation in the starting point being a capability. When the handle bar is attached to the end of the extension tube, it may be used for chin-ups with the extension tube keeping the user free of the weights while performing certain weight lifting exercises with the heavy punching bag also being oriented away from the weights so that is may be used without interference from the other components of the exercising machine.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An exercising machine comprising a vertical framework including a pair of parallel side members of channel-shaped configuration with the side members facing inwardly, a top member rigidly interconnecting the upper ends of the side members, means supporting the lower ends of the side members, a slide vertically slidable in each side member with each slide including an elongated slide member slidably mounted in the side member and a laterally extending arm at the lower end of the slide member with the arms extending toward each other but terminating in spaced relation, each of the arms including an upstanding peg for receiving weights, a cable attached to each of the slide members and extending upwardly to the top member, a pulley assembly on the top member receiving each of the cables, each of said cables having a handle means at the free end thereof to enable the slides individually to be vertically raised and lowered.

2. The structure as defined in claim 1 together with a locking bar extending between, rigidly and detachably interconnecting the arms thereby interconnecting the slides to form a single vertically movable assembly, said locking bar including a cable attached thereto, said top member including a central pulley assembly associated therewith for receiving the cable attached to the locking bar with the cable terminating in a handle means to enable reciprocation of the interconnected slides members with the cables attached to the individual slide members being removed.

3. The structure as defined in claim 2 together with an extension member on the top member and extending centrally and horizontally therefrom with the extension member including a pulley assembly over which the cable is entrained for raising and lowering the interconnected slides.

4. The structure as defined in claim 3 wherein said extension member is tubular and provided with an open end, a handlebar having a mounting bracket telescoped into and detachably connected to the open end of the extension member to provide an elevated handlebar on which chin-up exercises may be performed.

5. The structure as defined in claim 2 wherein said locking bar includes a horizontally extending, open-ended sleeve rigid therewith, a handlebar having a mounting bracket telescoped into and detachably connected to the sleeve to provide a handlebar to enable a user to assume a prone position under the connected slides and move the slides vertically by grasping the handlebar.

6. The structure as defined in claim 1 wherein said means supporting the lower ends of the side members includes a pair of supporting feet in the form of elongated structural members rigidly affixed to the side members in perpendicular relation thereto but in parallel relation to each other, a connecting bar extending between the end portions of the feet in spaced relation to the side members, said connecting bar including a pulley assembly adjacent each end thereof for receiving the cables to enable the handle means to be independently pulled upwardly to elevate the slides.

7. The structure as defined in claim 1 wherein said side members include a plurality of vertically spaced apertures, pins insertable through selected apertures with the pins having a hook-shaped bracket thereon to support a barbell assembly at a desired elevation.

8. The structure as defined in claim 7 wherein said hook shaped bracket provides support for one end of an inclined board to support a user when performing exercises.

9. The structure as defined in claim 8 wherein said pins provide a rest point for the slides to enable a user to assume a prone position and move the slides vertically by engagement with the feet.

10. The structure as defined in claim 8 together with a weighted T-bar pivoted from the framework below the inclined board to enable the T-bar to be used in conjunction with the board when performing exercises.

* * * * *